US009254670B2

(12) United States Patent
Ito

(10) Patent No.: US 9,254,670 B2
(45) Date of Patent: Feb. 9, 2016

(54) LIQUID EJECTING APPARATUS, ADAPTER, AND LIQUID SUPPLY SYSTEM

(71) Applicant: SEIKO EPSON CORPORATION, Tokyo (JP)

(72) Inventor: Koji Ito, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/498,655

(22) Filed: Sep. 26, 2014

(65) Prior Publication Data

US 2015/0103121 A1 Apr. 16, 2015

(30) Foreign Application Priority Data

Oct. 16, 2013 (JP) ..... 2013-215268

(51) Int. Cl.
*B41J 2/175* (2006.01)

(52) U.S. Cl.
CPC ..... *B41J 2/1752* (2013.01); *B41J 2/17509* (2013.01); *B41J 2/17506* (2013.01)

(58) Field of Classification Search
CPC ..... B41J 2202/21; B41J 2/16585; B41J 2/14427; B41J 2/14; B41J 2/51; B41J 2202/15; B41J 2/175; B41J 2/17523; B41J 2/17553; B41J 2/1752; B41J 29/02; B41J 2/17503; B41J 25/308; B41J 2/17506
See application file for complete search history.

(56) References Cited

U.S. PATENT DOCUMENTS

| | | | | |
|---|---|---|---|---|
| 7,306,330 | B2 * | 12/2007 | Ikezaki | 347/86 |
| 2006/0203045 | A1 | 9/2006 | Kobayashi et al. | |
| 2008/0006332 | A1 | 1/2008 | Ishizawa et al. | |
| 2014/0292955 | A1 * | 10/2014 | Kimura et al. | 347/85 |

FOREIGN PATENT DOCUMENTS

| | | |
|---|---|---|
| JP | 2006-224529 | 8/2006 |
| JP | 2008-037097 | 2/2008 |
| JP | 2011-042127 | 3/2011 |

* cited by examiner

*Primary Examiner* — Thinh Nguyen
(74) *Attorney, Agent, or Firm* — Workman Nydegger

(57) ABSTRACT

A liquid ejecting apparatus includes: a mounting section that is capable of moving in a state of mounting a medium; a liquid ejecting section that is capable of ejecting a liquid onto the medium mounted on the mounting section; and an adapter that has an injecting section capable of injecting the liquid and an outlet section capable of flowing the liquid out to the liquid ejecting section, in which the injecting section of the adapter is disposed below the mounting section in a vertical direction.

11 Claims, 3 Drawing Sheets

LIQUID EJECTING APPARATUS, ADAPTER, AND LIQUID SUPPLY SYSTEM

BACKGROUND

1. Technical Field

The present invention relates to a liquid ejecting apparatus such as a printer, an adapter mounted on the liquid ejecting apparatus, and a liquid supply system including the adapter.

2. Related Art

As an example of a liquid ejecting apparatus, there is an ink jet type printer that includes a main tank that can replenish ink that is a liquid and a recording head that is capable of ejecting the ink, in which printing is performed by ejecting the ink that is supplied from the main tank from the recording head onto a sheet (for example, JP-A-2008-37097).

However, the main tank described above is provided with an injecting section for replenishing the ink, but the ink or the like that is spilled when replenishing the ink is likely to be adhered to the injecting section. Thus, for example, when performing the printing while moving a sheet toward the recording head, there is a problem that the moving sheet becomes contaminated when coming into contact with the injecting section.

Moreover, such a problem is not limited to the ink jet type printer that performs the printing onto the sheet and is almost common in a liquid ejecting apparatus that ejects a liquid with respect to a moving medium.

SUMMARY

An advantage of some aspects of the invention is to provide a liquid ejecting apparatus in which an injecting section for liquid is prevented from coming into contact with a medium where the liquid is ejected, an adapter, and a liquid supply system.

Hereinafter, means of the invention and operation effects thereof will be described.

According to an aspect of the invention, there is provided a liquid ejecting apparatus including: a mounting section that is capable of moving in a state of mounting a medium; a liquid ejecting section that is capable of ejecting a liquid onto the medium mounted on the mounting section; and an adapter that has an injecting section capable of injecting the liquid and an outlet section capable of flowing the liquid out to the liquid ejecting section, in which the injecting section of the adapter is disposed below the mounting section in a vertical direction.

In this case, since the adapter has the injecting section that is capable of injecting the liquid and the outlet section in which the liquid can flow out, it is possible to supply the liquid to the liquid ejecting section through the adapter by injecting the liquid through the injecting section. Then, since the injecting section of the adapter is disposed below the mounting section mounting the medium in the vertical direction, the medium is unlikely to come into contact with the injecting section, even when the medium moves together with the mounting section. Therefore, it is possible to suppress the contact between the injecting section for the liquid and the medium onto which the liquid is ejected.

The liquid ejecting apparatus may further include: a housing section that accommodates the liquid ejecting section; and an installing section that is capable of installing the adapter, in which the adapter may have a liquid storing section that stores the liquid injected from the injecting section and a protrusion section that protrudes to the outside of the housing section when being installed in the installing section, and the injecting section may be disposed in the protrusion section.

In this case, since the adapter has the protrusion section that protrudes to the outside of the housing section when being installed in the installing section, it is possible to increase the liquid storing section and to store much more the liquid without being restricted by the size of the housing section by disposing the liquid storing section in the protrusion section. Furthermore, since the injecting section is disposed in the protrusion section of the adapter, the liquid is likely to be injected from the outside of the housing section to the injecting section.

The installing section may be disposed in a position different from the mounting section in a direction intersecting both a moving direction of the mounting section and the vertical direction. The protrusion section may protrude from the housing section in a direction along the moving direction and the injecting section may protrude from the protrusion section upward in the vertical direction when installing the adapter in the installing section.

In this case, since the installing section is disposed in a position different from the mounting section in the direction intersecting both the moving direction of the mounting section and the vertical direction, it is possible to suppress the contact between the protrusion section of the adapter protruding in the direction along the moving direction and the medium moving together with the mounting section. Furthermore, since the injecting section is disposed in the protrusion section of the adapter, it is possible to suppress the contact between the injecting section and the medium and to suppress the interference between the injecting section and the housing section. Furthermore, since the injecting section protrudes upward from the protrusion section in the vertical direction, it is possible to inject the liquid so as to fill the upper portion of the liquid storing section and the liquid is unlikely to be spilled from the injecting section, even if the adapter is vibrated in a state where the liquid enters the upper portion of the liquid storing section.

The mounting section may be capable of moving in a mounting position to allow mounting of the medium from the outside of the housing section onto the mounting section, and the injecting section may be positioned closer to the housing section than the mounting section when the mounting section is in the mounting position.

In this case, since the injecting section is positioned closer to the housing section than the mounting section when the mounting section is in the mounting position that is the outside of the housing section, the medium is unlikely to come into contact with the injecting section that exists outside of the housing section, when performing the mounting operation of the medium on the mounting section outside the housing section.

The liquid ejecting apparatus may further include: an installing section in which a liquid accommodating body capable of accommodating the liquid is removably installed; and a housing section that accommodates the liquid ejecting section and the installing section, in which an operation space for operating the liquid accommodating body installed in the installing section may be provided in an upper portion of the installing section inside the housing section, and in which the adapter may be capable of being installed in the installing section, and the injecting section may be disposed in the operation space when the adapter is installed in the installing section.

In this case, when installing the liquid accommodating body in the installing section, it is possible to supply the liquid accommodated in the liquid accommodating body to the liquid ejecting section. Then, since the operation space for operating the liquid accommodating body that is installed in the installing section is provided on the upper portion of the installing section, it is possible to perform the operation such as mounting and dismounting of the liquid accommodating body, and the like in the operation space. Furthermore, when installing the adapter in the installing section, it is possible to supply the liquid to the liquid ejecting section through the adapter. Then, when installing the adapter in the installing section, since the injecting section is disposed in the operation space, it is possible to inject the liquid into the injecting section through the operation space.

According to another aspect of the invention, there is provided an adapter that is capable of being installed in a liquid ejecting apparatus including a mounting section that is capable of moving in a state of mounting a medium and a liquid ejecting section that is capable of ejecting a liquid onto the medium mounted on the mounting section, the adapter including: an injecting section that is capable of injecting the liquid; and an outlet section that is capable of flowing out the liquid to the liquid ejecting section, in which the injecting section is disposed below the mounting section in a vertical direction when installing in the liquid ejecting apparatus.

In this case, it is possible to obtain the same operational effects as the liquid ejecting apparatus.

According to still another aspect of the invention, there is provided a liquid supply system including: the adapter; a liquid supply tube of which a front end side is connected to the injecting section; and a liquid storing body to which a base end side of the liquid supply tube is connected, in which the liquid stored in the liquid storing body is supplied to the liquid ejecting section through the liquid supply tube and the adapter.

In this case, it is possible to continuously eject the liquid while injecting the liquid from the liquid storing body into the adapter by connecting the front end side of the liquid supply tube connected to the base end side of the liquid storing body to the injecting section. Then, since the injecting section of the adapter is disposed below the mounting section in the vertical direction, the medium is unlikely to come into contact with the injecting section. Therefore, it is possible to suppress the contact between the injecting section of liquid and the medium.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of a liquid ejecting apparatus will be described with reference to the drawings. For example, the liquid ejecting apparatus is a printer that performs recording (printing) by ejecting ink that is an example of a liquid onto a medium such as a sheet.

Figure 1:
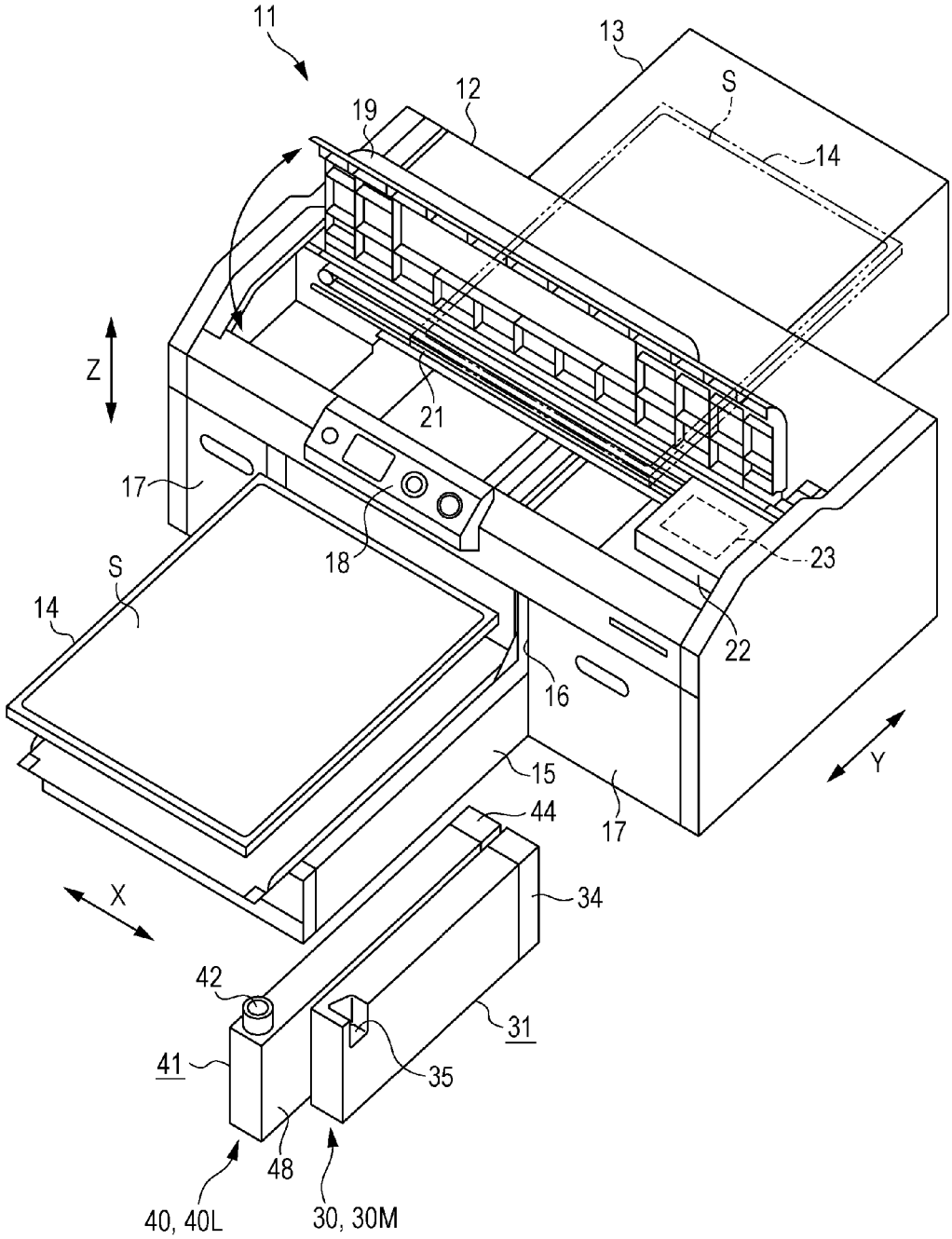
FIG. 1 is a perspective view of a liquid accommodating body, an adapter, and a liquid ejecting apparatus of an embodiment.

As illustrated in FIG. 1, a liquid ejecting apparatus 11 of the embodiment includes a substantially rectangular box-shaped housing section 12, an accommodating section 13 that protrudes from the housing section 12, a mounting section 14 that is movable in a state of mounting a medium S, and a transport section 15 that moves the mounting section 14.

Moreover, in the embodiment, a direction in which the accommodating section 13 protrudes from the housing section 12 is referred to as backward and a direction in which the transport section 15 protrudes from the housing section 12 is referred to as forward. Then, a direction in which the transport section 15 moves the mounting section 14 along a front/rear direction in which the housing section 12 and the accommodating section 13 are arranged is illustrated as a moving direction Y. Furthermore, a direction intersecting (orthogonal in the embodiment) both an up and down direction Z along the vertical direction and the moving direction Y, and becoming a longitudinal direction of the housing section 12 is illustrated as a width direction X.

An opening section 16 that allows the mounting section 14 to enter and exit the housing section 12 by movement along the moving direction Y is formed on a front surface of the housing section 12. Furthermore, a space that allows the mounting section 14 to move along the moving direction Y is formed inside the housing section 12 and the accommodating section 13 over the housing section 12 and the accommodating section 13.

Figure 2:
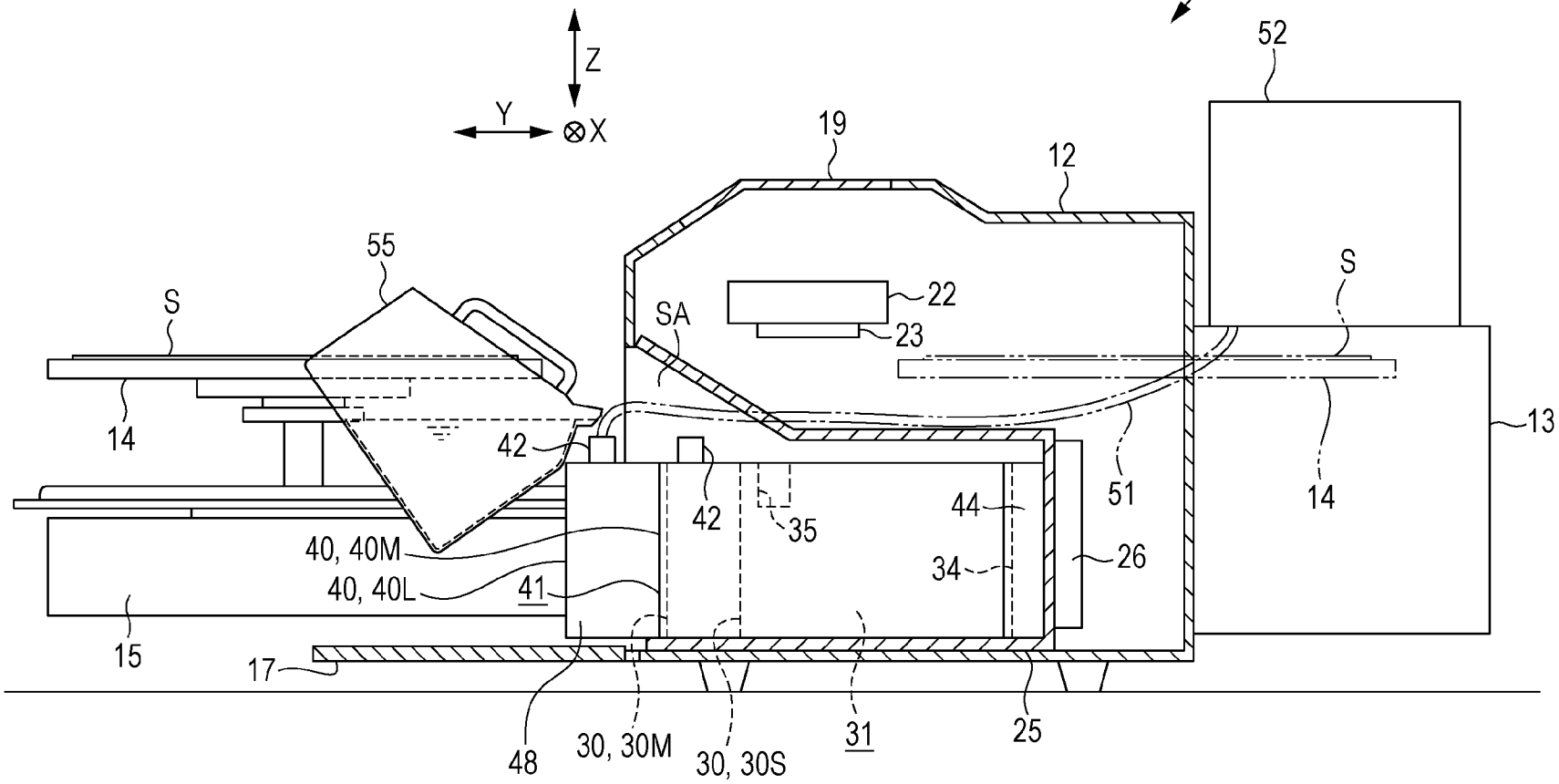
FIG. 2 is a cross-sectional view of a liquid ejecting apparatus in which the adapter of the embodiment is installed.

The mounting section 14 reciprocates between a mounting position indicated by a solid line in FIGS. 1 and 2 and a print starting position indicated by a two-dot chain line in FIGS. 1 and 2 along the moving direction Y. Moreover, the mounting position is a position for mounting the medium S on the mounting section 14 outside the housing section 12 and the print starting position is a position in which the mounting section 14 is temporarily stopped before moving toward a liquid ejecting section 23 for printing. Then, when the mounting section 14 is in the print starting position, a rear end side of the mounting section 14 is disposed inside the accommodating section 13.

A guide shaft 21 extending along the width direction X is provided inside the housing section 12. A carriage 22 is supported on the guide shaft 21 in a state of being capable of moving in the width direction X. Then, the carriage 22 reciprocates in a main scanning direction along the width direction X by movement of a drive source (not illustrated).

The carriage 22 is equipped with the liquid ejecting section 23 that is capable of ejecting the liquid such as the ink onto the medium S mounted on the mounting section 14 inside the housing section 12. Then, the liquid ejecting section 23 performs the printing onto the medium S by ejecting the liquid onto the medium S moving forward from the print starting position together with the mounting section 14.

An input panel 18 that inputs commands regarding an operation of the liquid ejecting apparatus 11 is attached to an upper side of the opening section 16. Furthermore, an upper cover 19 that covers an opening section that allows a user to access the inside of the housing section 12 when performing maintenance is rotatably provided on the rear side of the input panel 18. The upper cover 19 is disposed between an open position illustrated in FIG. 1 in which the user is capable of accessing the inside of the housing section 12 and a closed position illustrated in FIG. 2 by rotating about a rotation shaft (not illustrated) provided on a base end side.

Opening/closing covers 17 are rotatably attached to positions that are on both sides of the opening section 16 in the width direction X on the front surface side of the housing section 12. The opening/closing covers 17 are disposed between a closed position illustrated in FIG. 1 and an open position illustrated in FIG. 2 by rotating about a rotation shaft (not illustrated) provided on the lower end side thereof so that the upper end side thereof swings.

As illustrated in FIG. 2, an installing section 25 is accommodated in the housing section 12 in a position that is different from the mounting section 14 in the width direction X intersecting both the vertical direction and the moving direction Y and a position that is on a rear side of the opening/closing covers 17. A liquid accommodating body 30 that is capable of accommodating the liquid supplied to the liquid ejecting section 23 and an adapter 40 are replaceably and removably installed in the installing section 25.

The installing section 25 becomes a state of being visible when the opening/closing cover 17 is disposed at the open position. Moreover, in the embodiment, the installing sections 25 are provided on both sides of the housing section 12 in the width direction X, but the installing section 25 may be installed on one side of the housing section 12 in the width direction X. Furthermore, the number of the liquid accommodating bodies 30 and the adapters 40 capable of being installed in the installing section 25 may be arbitrarily changed.

The installing section 25 is open to the front side. Then, the liquid accommodating body 30 and the adapter 40 are installed in the installing section 25 by being moved to the rear side after being inserted from an opening of the installing section 25. Furthermore, the liquid accommodating body 30 and the adapter 40 installed in the installing section 25 are removed from the installing section 25 by being moved from the installing section 25 to the front side.

The installing section 25 is provided with a connection section 26 at a rear portion that is the rear side of the housing section 12. The liquid accommodating body 30 has an outlet section 34 that is connected to the connection section 26 when being installed in the installing section 25 and in which the accommodated ink can flow out to the liquid ejecting section 23. Furthermore, the adapter 40 has an outlet section 44 that is connected to the connection section 26 when being installed in the installing section 25 and in which the liquid can flow out to the liquid ejecting section 23.

Figure 3:
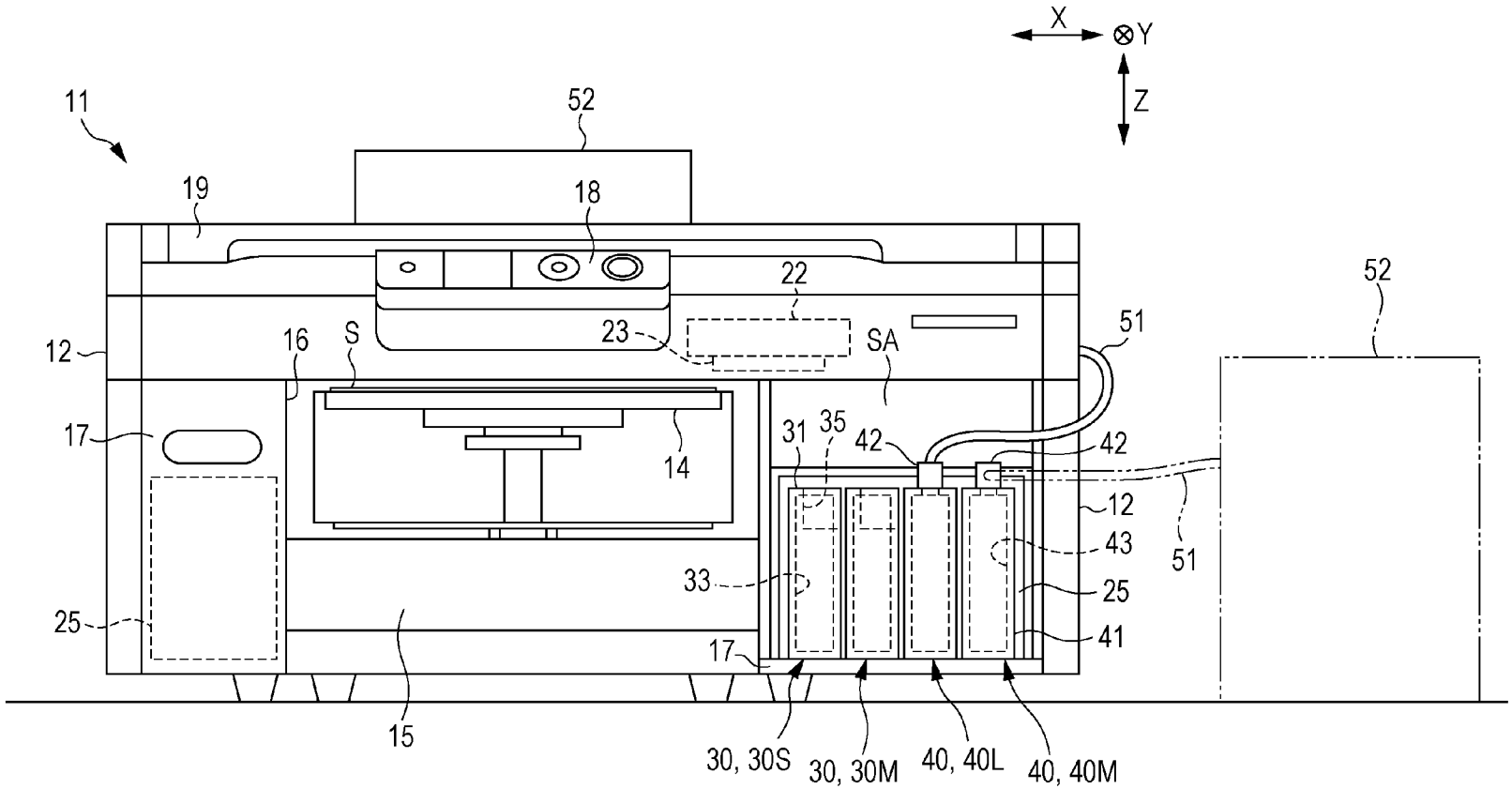
FIG. 3 is a front view of a liquid supply system including the adapter of the embodiment.

As illustrated in FIG. 3, the adapter 40 has a substantially rectangular box-shaped case member 41, a liquid storing section 43 that is capable of storing the liquid inside the case member 41, and an injecting section 42 that is capable of injecting the liquid into the liquid storing section 43. Therefore, when the liquid stored in the liquid storing section 43 of the adapter 40 is low, it is possible to replenish the liquid by injecting the liquid into the liquid storing section 43 through the injecting section 42.

The injecting section 42 of the adapter 40 is provided so as to protrude upward from the upper surface of the case member 41 in the vertical direction and communicates with the liquid storing section 43. Then, the injecting section 42 of the adapter 40 installed in the installing section 25 is disposed below the mounting section 14 in the vertical direction.

The liquid accommodating body 30 includes a substantially rectangular box-shaped case member 31 and a liquid accommodating section 33 that is capable of accommodating the liquid inside the case member 31, but does not include an injecting section for injecting the liquid into the liquid accommodating section 33. Therefore, if the liquid accommodated in the liquid accommodating section 33 is exhausted, the liquid accommodating body 30 installed in the installing section 25 is replaced with another liquid accommodating body 30 in which the liquid is accommodated. Moreover, a finger hooking concave section 35, which is capable of hooking a finger when performing a mounting and dismounting operation with respect to the installing section 25 at an upper portion of a portion that is the front side when being installed in the installing section 25, is formed in the case member 31 of the liquid accommodating body 30 (also see FIG. 1).

As illustrated in FIGS. 1 and 2, the liquid accommodating body 30 and the adapter 40 having different lengths in the moving direction Y that is a depth direction of the housing section 12 are replaceably installed in the installing section 25.

As illustrated in FIG. 2, for example, two types of liquid accommodating bodies 30 (30M and 30S) of which lengths are different from each other in the moving direction Y and two types of adapters 40 (40L and 40M) of which lengths are different from each other in the moving direction Y are installed in the installing section 25. Moreover, the lengths of the liquid accommodating body 30M and the adapter 40M are substantially equal to each other and the length of the liquid accommodating body 30S is shorter than that of the liquid accommodating body 30M in the moving direction Y and length of the adapter 40L is longer than that of the adapter 40M in the moving direction Y.

If the outlet section 34 is connected to the connection section 26 of the installing section 25, the liquid accommodating body 30 becomes a state where the liquid can be supplied to the liquid ejecting section 23. Furthermore, if the outlet section 44 is connected to the connection section 26 of the installing section 25, the adapter 40 becomes a state where the liquid can be supplied to the liquid ejecting section 23. Thus, the liquid accommodating body 30 and the adapter 40 are inserted deep into the installing section 25 even when having any size when being installed in the installing section 25.

Thus, each of the front end positions of the liquid accommodating body 30S, the liquid accommodating body 30M, the adapter 40M, and the adapter 40L is deviated when being insulated in the installing section 25. Specifically, the front end positions of the liquid accommodating body 30M and the adapter 40M are positioned inside the opening of the installing section 25, and the front end position of the liquid accommodating body 30S is positioned on the rear side (rear side of the installing section 25) of the liquid accommodating body 30M and the adapter 40M. Furthermore, the front end position of the adapter 40L protrudes to the front side of the opening of the installing section 25.

That is, the adapter 40L has a protrusion section 48 that protrudes to the front side (a direction along the moving direction Y) that is the outside of the housing section 12 when being installed in the installing section 25. Then, the injecting section 42 of the adapter 40L is disposed on the upper portion of the protrusion section 48 so as to protrude upward in the vertical direction. Moreover, since the injecting section 42 and the protrusion section 48 become a state of protruding to the outside of the housing section 12 when the adapter 40L is installed in the installing section 25, the printing is performed in a state where the opening/closing cover 17 is disposed in the open position.

When the mounting section 14 is at the mounting position in which the mounting section 14 is exposed to the outside of the housing section 12, the protrusion section 48 and the injecting section 42 of the adapter 40L installed in the installing section 25 are positioned in a position closer to the housing section 12 than the mounting section 14 and are disposed in a position that is outside of a moving region of the mounting section 14.

An operation space SA for performing the mounting and demounting operation of the liquid accommodating body 30 with respect to the installing section 25 is provided on the upper portion close to the opening of the installing section 25 inside the housing section 12. That is, the operation space SA is a space for inserting a hand of the user, for example, when the finger of the user is hooked in the finger hooking concave section 35 of the liquid accommodating body 30 from above to remove the liquid accommodating bodies 30 (30M and 30S) installed in the installing section 25.

Then, if the adapter 40M is installed in the installing section 25, the injecting section 42 of the adapter 40M is disposed in the operation space SA. That is, the adapter 40 has the injecting section 42 that protrudes upward from the case member 41, but interference between the injecting section 42 and the installing section 25 is avoided because the operation space SA that is capable of accommodating the injecting section 42 exists inside the housing section 12.

Next, an operation of the liquid ejecting apparatus 11 configured as described above, will be described.

As illustrated in FIGS. 2 and 3, if a liquid supply system includes a liquid supply tube 51 of which a front end side is connected to the injecting section 42 of the adapter 40L, and the liquid storing body 52 to which a back end side of the liquid supply tube 51 is connected, the liquid supply system can be configured to supply liquid stored in the liquid storing body 52 to the liquid ejecting section 23 through the liquid supply tube 51 and the adapter 40L. Moreover, if the liquid supply tube 51 is configured of a tube having flexibility, it is preferable that the degree of freedom of the arrangement of the liquid storing body 52 can be increased.

When employing such a liquid supply system, since the liquid storing body 52 can be disposed outside of the housing section 12, it is possible to store the liquid more than that in the liquid accommodating section 33 of the liquid accommodating body 30 without being restricted by the size of the housing section 12. Furthermore, since the adapter 40L also has the protrusion section 48 protruding from the housing section 12, it is possible to store the liquid in the liquid storing section 43 more than that of the liquid accommodating section 33 of the liquid accommodating body 30 without being restricted by the size of the housing section 12.

Then, if the adapter 40L stores much of the liquid, it is possible to continuously perform the printing operation in an amount greater than that of a case where the liquid stored in the liquid accommodating body 30 is supplied without being stopped by replacement of the liquid accommodating body 30 and the like.

Specifically, if the amount of the liquid that is consumed in the printing with respect to one medium S is great, it is necessary to stop the printing for replacing the liquid accommodating body 30 if the liquid accommodated in the liquid accommodating body 30 is exhausted during the printing with respect to the medium S. However, if the printing is stopped during the printing, there is a concern that the color of the ink may change before and after the stop and thereby printing quality may be degraded. In that case, if the storing amount of the liquid is increased in the adapter 40 or the liquid storing body 52, it is possible to continuously perform the printing. Therefore, it is possible to suppress the degradation of the printing quality due to the stop of the printing.

Furthermore, since the printing can be continuously performed while replenishing the liquid in the liquid storing section 43 of the adapter 40 from the liquid storing body 52 if the liquid supply tube 51 is connected to the injecting section 42 of the adapter 40, it is possible to further continuously perform the printing.

That is, it is preferable that the liquid accommodating body 30 of the embodiment be a relatively small container that is formed to be sized capable of being accommodated inside the housing section 12 and the liquid storing body 52 be a large container that is capable of accommodating more of the liquid than that in the liquid accommodating body 30.

For example, the liquid storing body 52 may be mounted on the accommodating section 13. Thus, since the liquid storing body 52 is disposed above the mounting section 14, the liquid can flow down from the liquid storing body 52 toward the injecting section 42 that is disposed below the mounting section 14 in the vertical direction.

Furthermore, the injecting section 42 of the adapter 40L is positioned in a position closer to the housing section 12 in the moving direction Y than the mounting section 14 that is in the mounting position, that is, is to the rear of the mounting section 14 and the medium S that is in the mounting position. Thus, if the liquid storing body 52 is disposed at the rear of the housing section 12, since the liquid supply tube 51 is pulled around from the injecting section 42 to the rear side, the medium S or the user is unlikely to come into contact with the injecting section 42, the liquid supply tube 51, and the liquid storing body 52, when mounting the medium S on the mounting section 14 in the mounting position or when removing the medium S for which the printing is completed from the mounting section 14 that is in the mounting position.

Moreover, the liquid supply tube 51 of which the base end side is connected to the liquid storing body 52 can be connected to the injecting section 42 of the adapter 40M. In this case, the liquid supply tube 51 may be connected to the injecting section 42 of the adapter 40M from above the liquid supply tube 51 and the liquid supply tube 51 may be connected to the injecting section 42 from the front side, as indicated by the two-dot chain line in FIG. 3. In any case, since the injecting section 42 protrudes from the case member 41, the liquid supply tube 51 is likely to be connected. Then, if the liquid supply tube 51 is connected to the injecting section 42 from the front side, it is possible to connect the liquid supply tube 51 to the injecting section 42 of the adapter 40M installed in the installing section 25, even if the space (operation space SA) for inserting the liquid supply tube 51 does not exist at the upper portion of the installing section 25.

Furthermore, as indicated by a two-dot chain line in FIG. 3, since the injecting section 42 of the adapters 40L and 40M installed in the installing section 25 is disposed below the mounting section 14 even if the liquid storing body 52 is mounted on the side of the housing section 12, the medium S moving together with the mounting section 14 is unlikely to come into contact with the injecting section 42.

In addition, as illustrated in FIGS. 2 and 3, since the injecting section 42 of the adapters 40M and 40L installed in the installing section 25 is positioned below the upper cover 19, the user is unlikely to come into contact with the injecting section 42 and the liquid supply tube 51 connected to the injecting section 42, when the user opens the upper cover 19 and then accesses the inside of the housing section 12.

Furthermore, as illustrated in FIG. 2, after the liquid is injected from a container 55 into the injecting section 42 of the adapter 40L, the injecting section 42 is covered by a cover or the like, and then the printing may be performed. In this case, when injecting the liquid into the injecting section 42, there is a concern that the liquid that is spilled from the container 55 or flooded from the injecting section 42 may adhere to the injecting section 42, but since the injecting section 42 is disposed below the mounting section 14, the liquid adhered to the injecting section 42 is unlikely to adhere to the medium S.

Moreover, in the embodiment, when the mounting section 14 is in the mounting position, the protrusion section 48 is also positioned closer to the housing section 12 than the mounting section 14 in addition to the injecting section 42 of the adapter 40L, but if at least the injecting section 42 is positioned closer to the housing section 12 than the mounting section 14, the contact between the injecting section 42 and the medium S is suppressed. However, when injecting the liquid from the container 55 into the injecting section 42, since there is a concern that spilled liquid may adhere to the protrusion section 48, if the protrusion section 48 is also positioned closer to the housing section 12 than the mounting section 14, it is possible to suppress contamination of the medium S due to the adhering of the liquid.

According to the embodiment described above, the following advantages can be obtained.

(1) Since the adapter 40 has the injecting section 42 that is capable of injecting the liquid and the outlet section 44 in which the liquid can flow out, it is possible to supply the liquid to the liquid ejecting section 23 through the adapter 40 by injecting the liquid through the injecting section 42. Then, since the injecting section 42 of the adapter 40 is disposed below the mounting section 14 mounting the medium S in the vertical direction, the medium S is unlikely to come into contact with the injecting section 42, even when the medium S moves together with the mounting section 14. Therefore, it is possible to suppress the contact between the injecting section 42 of the liquid and the medium S onto which the liquid is ejected.

(2) Since the adapter 40 has the protrusion section 48 that protrudes to the outside of the housing section 12 when being installed in the installing section 25, it is possible to increase the liquid storing section 43 and to store much more the liquid without being restricted by the size of the housing section 12 by disposing the liquid storing section 43 in the protrusion section 48. Furthermore, since the injecting section 42 is disposed in the protrusion section 48 of the adapter 40, the liquid is likely to be injected from the outside of the housing section 12 to the injecting section 42.

(3) Since the installing section 25 is disposed in the position different from the mounting section 14 in the direction intersecting both the moving direction Y of the mounting section 14 and the vertical direction, it is possible to suppress the contact between the protrusion section 48 of the adapter 40 protruding in the direction along the moving direction Y and the medium S moving together with the mounting section 14. Furthermore, since the injecting section 42 is disposed in the protrusion section 48 of the adapter 40, it is possible to suppress the contact between the injecting section 42 and the medium S and to suppress the interference between the injecting section 42 and the housing section 12.

(4) Since the injecting section 42 protrudes upward from the protrusion section 48 in the vertical direction, it is possible to inject the liquid so as to fill the upper portion of the liquid storing section 43 and the liquid is unlikely to be spilled from the injecting section 42, even if the adapter 40 is vibrated in a state where the liquid enters the upper portion of the liquid storing section 43.

(5) Since the injecting section 42 is positioned closer to the housing section 12 than the mounting section 14 when the mounting section 14 is in the mounting position that is outside of the housing section 12, the medium S is unlikely to come into contact with the injecting section 42 that exists outside of the housing section 12, when performing the mounting operation of the medium S on the mounting section 14 outside the housing section 12.

(6) When installing the liquid accommodating body 30 in the installing section 25, it is possible to supply the liquid accommodated in the liquid accommodating body 30 to the liquid ejecting section 23. Then, since the operation space SA for operating the liquid accommodating body 30 that is installed in the installing section 25 is provided on the upper portion of the installing section 25, it is possible to perform the operation such as mounting and dismounting of the liquid accommodating body 30, and the like in the operation space SA. Furthermore, when installing the adapter 40 in the installing section 25, it is possible to supply the liquid to the liquid ejecting section 23 through the adapter 40. Then, when installing the adapter 40 in the installing section 25, since the injecting section 42 is disposed in the operation space SA, it is possible to inject the liquid into the injecting section 42 through the operation space SA.

(7) It is possible to continuously eject the liquid while injecting the liquid from the liquid storing body 52 into the adapter 40 by connecting the front end side of the liquid supply tube 51 connected to the base end side of the liquid storing body 52 to the injecting section 42. Then, since the injecting section 42 of the adapter 40 is disposed below the mounting section 14 in the vertical direction, the medium S is unlikely to come into contact with the injecting section 42. Therefore, it is possible to suppress the contact between the injecting section 42 of liquid and the medium S.

Moreover, the embodiments described above may be changed as below.

- It is also possible to configure the adapter 40 that is not provided with the liquid storing section 43. In this case, a liquid conduit connecting the injecting section 42 and the outlet section 44 may be provided in the adapter 40. Moreover, in this case, the injecting section 42, the liquid conduit, and the outlet section 44 may be integrally formed with the case member 41, or formed separated from the case member 41 and then the injecting section 42, the liquid conduit, and the outlet section 44 that are connected to each other may be installed in the case member 41. According to the configuration, it is possible to supply the liquid from the liquid storing body 52 to which the base end side of the liquid supply tube 51 is connected to the liquid ejecting section 23 through the liquid supply tube 51, the injecting section 42, the liquid conduit, and the outlet section 44 by connecting the front end side of the liquid supply tube 51 to the injecting section 42. Moreover, in a case of employing the configuration, the injecting section 42 may be disposed on the side of the case member 41 and the size of the case member 41 of the adapter 40 may have a small size similar to the liquid accommodating body 30S.
- The injecting section 42 of the adapter 40 may protrude from the case member 41. Moreover, also in this case, when installing the adapter 40 in the installing section 25, it is possible to dispose the liquid supply tube 51 connected to the injecting section 42 in the operation space SA or to perform the injection operation of the liquid into the injecting section 42 in the operation space SA, if the injecting section 42 is disposed in the position facing the operation space SA.
- The injecting section 42 of the adapter 40 may protrude toward a direction (front side that is the opening side of the installing section 25) in which the adapter 40 is taken out. Moreover, if the injecting section 42 of the adapter 40 protrudes in the direction in which the adapter 40 is taken out, the case member 41 of the adapter 40 installed in the installing section 25 is accommodated inside the housing section 12 and the injecting section 42 of the adapter 40 may protrude to the outside of the housing section 12. According to the configuration, since the liquid can be injected into the injecting section 42 outside of the housing section 12, workability is good.

Only the adapter 40 may be installed without installing the liquid accommodating body 30 in the installing section 25. Furthermore, it is possible to arbitrarily change the size (a length in the width direction X, a length in the up and down direction Z, or a length in the moving direction Y) or the number of the adapters 40 that are installed in the installing section 25.

The adapter 40 may not have the configuration capable of being mounted and dismounted in the installing section 25 and may be removed after being installed in the housing section 12.

If the adapter 40 having the protrusion section 48 is installed in the installing section 25, the opening/closing cover 17 may not be provided. Furthermore, the installing section 25 may not be accommodated inside the housing section 12 and a part of or an entirety thereof may be exposed to the outside of the housing section 12.

It is possible to arbitrarily change the shape of the operation space SA and it is possible to not provide the operation space SA if the liquid accommodating body 30S of which the length is short in the moving direction Y is not installed in the installing section 25, or if the injecting section 42 of the adapter 40M does not protrude upward from the case member 41. Moreover, as the embodiment, the operation space SA is formed to widen the opening area toward the opening side from the rear side of the installing section 25. Therefore, it is preferable that an access property to the finger hooking concave section 35 of the liquid accommodating body 30 installed in the installing section 25 can be secured without excessively widening the operation space SA.

The moving direction Y of the mounting section 14 is not limited to the horizontal direction and may be moved in a direction intersecting the horizontal direction such as an upward direction inclined from the mounting position or a downward direction inclined therefrom. Then, also, in this case, when disposing the injecting section 42 below the lowest position inside the moving area of the mounting section 14, it is possible to suppress the contact between the injecting section 42 and the medium S mounted on the mounting section 14. Moreover, if the mounting section 14 moves in the direction intersecting the horizontal direction, it is possible to use a member (for example, a frame member or the like pressing the medium S in a state where the printing surface is exposed) fixing the medium S mounted on the mounting section 14 to the mounting section 14. Then, even if a mounting operation of such a member on the mounting section 14 is performed, it is preferable that the injecting section 42 be disposed below the mounting section 14 in the vertical direction because the injecting section 42 does not interfere with the mounting operation.

The liquid ejecting apparatus 11 can be changed to a so-called full-line type liquid ejecting apparatus including the liquid ejecting section 23 that is fixed in an elongated shape corresponding to an entire width of the medium S without including the carriage 22. In this case, the liquid ejecting section 23 is configured such that a printing range may be over an entire width of the medium S by arranging a plurality of unit heads in which nozzles ejecting the liquid are formed in parallel and the printing range may be over the entire width of the medium S by arranging a plurality of nozzles so that a single elongated head is over the entire width of the medium S.

Moreover, the recording material used in the recording may be fluid (including the liquid, a liquid body in which particles of a functional material are dispersed in or mixed into a liquid, a fluid-like material such as a gel, and a solid that can be ejected by flowing as a fluid) other than the ink. For example, the recording may be performed by ejecting a liquid body containing a material such as an electrode material or a color material (pixel material) that is used for manufacturing a liquid crystal display, an electroluminescence (EL) display, and a surface emitting display in a dispersed or dissolved form.

That is, the liquid ejecting apparatus performing the recording by ejecting a fluid may also be a fluid-like material ejecting apparatus ejecting a fluid-like material such as a gel (for example, physical gel) and a powder particle ejecting apparatus (for example, toner jet-type liquid ejecting apparatus) ejecting a solid as an example of a power (powder particles) such as toner. Moreover, "fluid" in the specification is a concept that does not include a fluid composed of only gas in the fluid and, for example, the fluid includes a liquid (including an inorganic solvent, an organic solvent, a solution, a liquid resin, a liquid metal (molten metal, and the like)), a liquid body, a fluid-like material, powder particles (including particles and powder), and the like.

The medium S is not limited to the sheet and may be a plastic film, a plate material, a hard panel, a cardboard, and the like, and may be a garment such as cloth or a T-shirt. Moreover, since the liquid ejecting apparatus 11 of the embodiment is provided with the mounting section 14 that moves while mounting the medium, the medium is not limited to the sheet-shaped medium S having flexibility such as the sheet and it is possible to perform the printing on a medium having an arbitrarily shape or a medium having no flexibility.

The entire disclosure of Japanese Patent Application No. 2013-215268, filed Oct. 16, 2013 is expressly incorporated by reference herein.

What is claimed is:

1. A liquid ejecting apparatus comprising:

a mounting section that is capable of moving in a state of mounting a medium;

a liquid ejecting section that is capable of ejecting a liquid onto the medium mounted on the mounting section; and an adapter that has a liquid storing section capable of storing the liquid and an outlet section capable of flowing the liquid out to the liquid ejecting section, wherein the adaptor includes an injecting section capable of injecting the liquid into the liquid storing section, the injecting section of the adapter being disposed below the mounting section in a vertical direction.

2. The liquid ejecting apparatus according to claim 1, further comprising:

a housing section that accommodates the liquid ejecting section; and an installing section that is capable of installing the adapter, wherein the adapter has a protrusion section that protrudes to the outside of the housing section when being installed in the installing section, and the injecting section is disposed in the protrusion section.

3. The liquid ejecting apparatus according to claim 2, wherein the installing section is disposed in a position different from the mounting section in a direction intersecting both a moving direction of the mounting section and the vertical direction, and wherein the protrusion section protrudes from the housing section in a direction along the moving direction and the injecting section protrudes from the protrusion section upward in the vertical direction when installing the adapter in the installing section.

4. The liquid ejecting apparatus according to claim 1, further comprising:

a housing section that accommodates the liquid ejecting section, wherein the mounting section is capable of moving in a mounting position to allow mounting of the medium from the outside of the housing section onto the mounting section, and wherein the injecting section is positioned closer to the housing section than the mounting section when the mounting section is in the mounting position.

5. The liquid ejecting apparatus according to claim 1, further comprising:

an installing section in which a liquid accommodating body capable of accommodating the liquid is removably installed; and a housing section that accommodates the liquid ejecting section and the installing section, wherein an operation space for operating the liquid accommodating body installed in the installing section is provided in an upper portion of the installing section inside the housing section, and wherein the adapter is capable of being installed in the installing section and the injecting section is disposed in the operation space when the adapter is installed in the installing section.

6. The liquid ejecting apparatus according to claim 1, wherein the injecting section protrudes upwards in the vertical direction from a top surface of a body of the adaptor.

7. The liquid ejecting apparatus according to claim 1, further comprising:

an installing section that is capable of installing the adapter, the installing section including a connection section that is connected to the liquid ejecting section, wherein the outlet section is capable of flowing the liquid out to the liquid ejecting section via the connection section when being connected to the connection section.

8. An adapter that is capable of being installed in a liquid ejecting apparatus including a mounting section that is capable of moving in a state of mounting a medium and a liquid ejecting section that is capable of ejecting a liquid onto the medium mounted on the mounting section, the adapter comprising:

a liquid storing section capable of storing the liquid; and an outlet section that is capable of flowing the liquid out to the liquid ejecting section; and an injecting section that is capable of injecting the liquid, wherein the injecting section is disposed below the mounting section in a vertical direction when installing in the liquid ejecting apparatus.

9. The adapter according to claim 8, wherein the liquid ejecting apparatus includes:

a housing section that accommodates the liquid ejecting section; and an installing section that is capable of installing the adapter, wherein the adapter has a protrusion section that protrudes to the outside of the housing section in a case of being installed in the installing section, and wherein the injecting section is disposed in the protrusion section.

10. The adapter according to claim 9, wherein the injecting section protrudes from the protrusion section upward in the vertical direction.

11. A liquid supply system comprising:

an adapter that is capable of being installed in a liquid ejecting apparatus including a mounting section that is capable of moving in a state of mounting a medium and a liquid ejecting section that is capable of ejecting a liquid onto the medium mounted on the mounting section, the adapter including: a liquid storing section capable of storing the liquid; an outlet section capable of flowing the liquid out to the liquid ejecting section; and, wherein the injecting section is disposed below the mounting section in a vertical direction when the adapter is installed in the liquid ejecting apparatus;

a liquid supply tube of which a front end side is connected to the injecting section; and a liquid storing body to which a base end side of the liquid supply tube is connected, wherein the liquid stored in the liquid storing body is supplied to the liquid ejecting section through the liquid supply tube and the adapter.

* * * * *